US005462111A

United States Patent [19]

Wardle

[11] Patent Number: 5,462,111

[45] Date of Patent: Oct. 31, 1995

[54] COOLING APPARATUS

[75] Inventor: David G. Wardle, Tadworth, England

[73] Assignee: The BOC Group plc, Windlesham, England

[21] Appl. No.: 218,381

[22] Filed: Mar. 25, 1994

[30] Foreign Application Priority Data

Mar. 29, 1993 [GB] United Kingdom ..... 9306496

[51] Int. Cl.[6] ..... F28D 15/00

[52] U.S. Cl. ..... 165/104.14; 62/63; 165/901

[58] Field of Search ..... 62/63, 64, 81; 165/104.14, 909, 901

[56] References Cited

U.S. PATENT DOCUMENTS

| | | | |
|---|---|---|---|
| 3,788,388 | 1/1974 | Barkmann | 165/104.14 |
| 3,884,292 | 5/1975 | Pessolano et al. | 165/104.26 |
| 4,276,753 | 7/1981 | Sandberg et al. . | |
| 4,333,520 | 6/1982 | Yanadori et al. . | |
| 4,403,479 | 9/1983 | Rasovich | 62/63 |
| 4,538,423 | 9/1985 | Le Diouron . | |
| 4,813,245 | 3/1989 | Hubert et al. . | |

FOREIGN PATENT DOCUMENTS

| | | |
|---|---|---|
| 0545668A2 | 6/1993 | European Pat. Off. . |
| 771878 | 10/1934 | France . |
| 3084377 | 4/1991 | Japan . |

*Primary Examiner*—A. Michael Chambers
*Attorney, Agent, or Firm*—R. Hain Swope; David A. Draegert; Larry R. Cassett

[57] ABSTRACT

A cooling apparatus comprises a cooling chamber (2), means (4) for introducing liquefied gas or its cold vapor thereinto, an exhaust passage (16) having flow inducing means associated therewith and a heat transfer means (46) associated with said exhaust passage (16) in which the heat transfer means operates to transfer heat from a heat source to the exhaust gas.

15 Claims, 1 Drawing Sheet

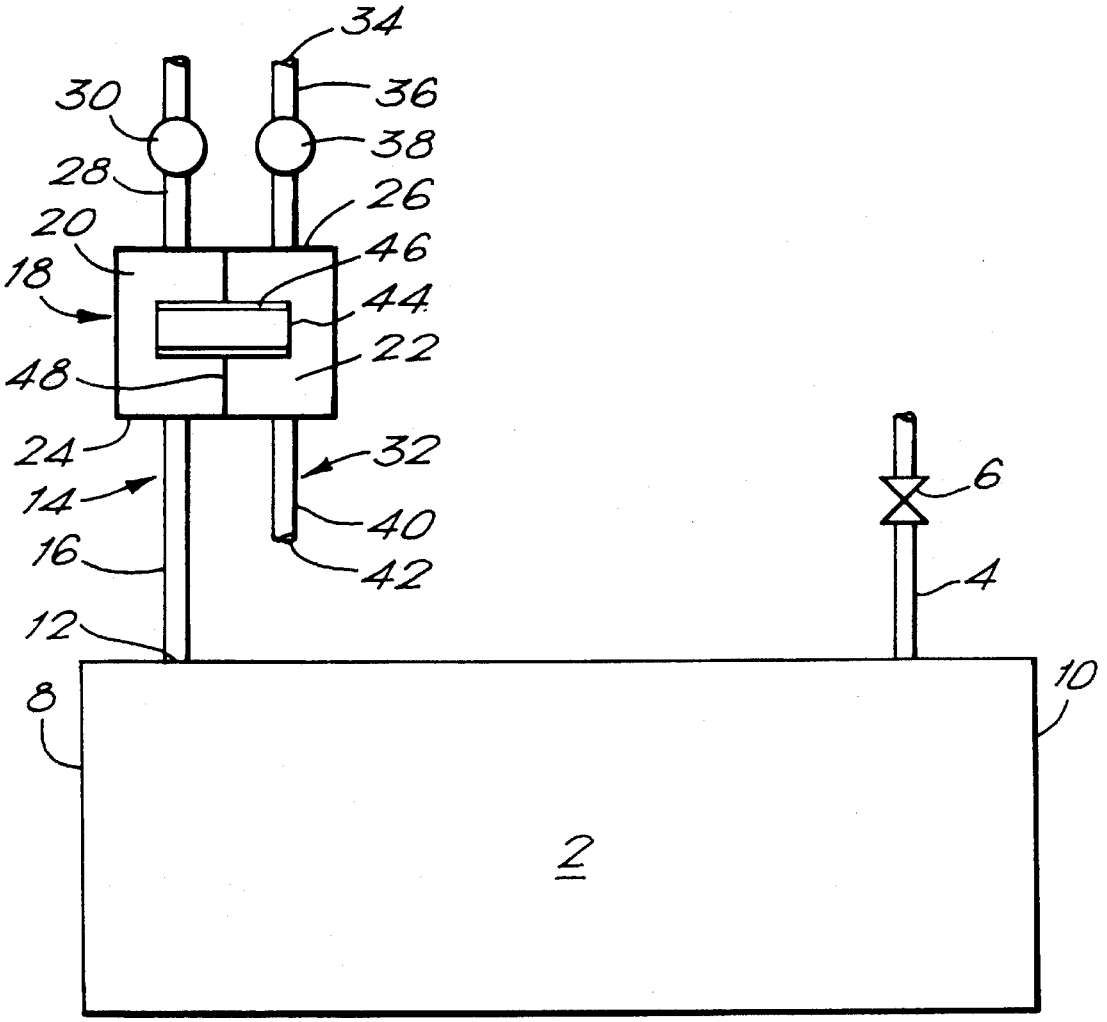
34
30
36
38
28
26
20
46
18
44
22
48
24
32
14
6
40
16
42
4
12
10
8
2

COOLING APPARATUS

This invention relates to cooling apparatus, particularly of the kind in which a liquefied gas or its cold vapour is introduced into a chamber to perform a cooling duty and cold spent gas is exhausted from the chamber.

BACKGROUND OF THE INVENTION

Such cooling apparatus is widely used in industry, for example in the freezing of food. A liquefied gas, typically liquid nitrogen, may be used to cool food in a tumbler or screw conveyor, or may be used to freeze food in a tunnel or a so-called immersion freezer. In the example of a freezing tunnel, food is advanced on a conveyor through a chamber in the form of a tunnel into which liquid nitrogen is injected. Typically, the liquid nitrogen is directed at the food and extracts heat therefrom as it vaporises. A fan or fans are employed to provide a flow of cold nitrogen vapour through the tunnel in a direction opposite to that in which the food is advanced through the tunnel. This flow of cold nitrogen vapour is also able to extract heat from the food. In order to limit the amount of cold nitrogen vapour that spills out of the ends of the tunnel, a fan is employed to extract the cold nitrogen vapour from a position in the tunnel between its ends. The fan typically communicates with an outlet in the roof of the tunnel. Since liquid nitrogen vaporises at a temperature of −196° C., the temperature of the vapour extracted from the tunnel is well below freezing point even though there has been heat exchange between the vapour and the food (or other articles or material being advanced through the tunnel) and dilution of the nitrogen vapour with air takes place in the tunnel.

The operation of the exhaust fan induces a flow of air into the tunnel. Measures need to be taken to prevent the cold exhaust gas from causing ice to be deposited on the fan. Otherwise, there is a risk that either damage is caused to the fan, in operation, by the ice or that there will be a sufficient accumulation of ice to prevent its operation.

The solution normally adopted to this problem is to provide the ducting by which the fan is placed in communication with the outlet from the tunnel with an adjustable inlet for ambient air. Typically, this inlet is designed so as to enable the fan to draw in a flow of ambient air into the ducting at a rate three or four times that at which the mixture of cold nitrogen vapour and air enters the ducting from the outlet of the freezing tunnel.

There are a number of disadvantages associated with such exhaust gas extraction systems. In particular, the extraction duct needs to be of greater diameter than it would otherwise have to be in order to cope with the induced air flow. Moreover, the refrigerative capacity of the extracted nitrogen vapour is wasted. In addition, if the ambient air has been conditioned, a common practice in food processing factories, extracting air with the nitrogen vapour effectively reduces the overall efficiency of the air conditioning system. A further disadvantage is that practical problems arise with the control of the extraction system. The operation of the exhaust fan is typically linked to a valve controlling the flow of liquid nitrogen into the tunnel. Since the tunnel may be operated in association with a widely varying range of belt loadings, the temperature of the nitrogen vapour at the outlet can vary widely even though the valve is controlled so as to give a desired product temperature at the tunnel exit. Accordingly, in practice, difficulties can arise in continuously maintaining the fan free of ice even though the exhaust gas is considerably diluted with air.

SUMMARY OF THE INVENTION

It is an aim of the present invention to provide a cooling apparatus which avoids the need to dilute with air the exhaust gas downstream of the freezing tunnel or other cooling chamber.

According to the present invention there is provided cooling apparatus comprising, a cooling chamber; means for introducing liquefied gas or its cold vapour into the chamber; an exhaust passage communicating with an outlet for exhaust gas comprising vapour of the liquefied gas from the cooling chamber; flow inducing means in said exhaust gas passage operable to draw exhaust gas therethrough; and at least one heat pipe having one end in heat transfer relationship with a region of said exhaust passage upstream of said flow inducing means and its other end in heat transfer relationship with a heat source, whereby, in operation, the heat pipe is able to transfer heat from said heat source to the exhaust gas and thereby warm the exhaust gas upstream of the flow inducing means.

The heat source preferably comprises a second passage through which relatively warm fluid is able to be passed. The relatively warm fluid is typically taken from a source of ambient air but may alternatively be taken from, for example, a source of water at approximately ambient temperature.

The flow inducing means is preferably a fan having a rotor located in said exhaust passage. A second fan is preferably employed to create the flow of air through the second passage.

Operation of the apparatus according to the invention makes it possible to warm the exhaust gas to above freezing point so as to prevent the deposition of ice on the fan. Moreover, if the relatively warm fluid is air taken from a factory or room which is air conditioned, the fluid may be returned to that room or factory at below ambient temperature, thus reducing the overall load on the air conditioning system. The apparatus according to the invention also obviates the need to dilute with air the gas extracted from the chamber, thus enabling the diameter of ducting used to define the exhaust passage to be less than any conventional systems.

The cooling apparatus may be of any kind in which liquefied gas, for example, liquid nitrogen, is used to perform a cooling duty. Thus, for example, the cooling chamber may comprise a tunnel through which articles to be cooled or frozen are advanced on a conveyor.

A heat pipe is a well known kind of transfer device which comprises a closed, typically elongate, chamber containing a working fluid under pressure. One end of the pipe is located in heat transfer relationship with a heat source from which heat is to be extracted and the other end of the pipe is located in heat transfer relationship with a medium which is to be heated. The working fluid and its pressure are selected such that the vapour phase of the working fluid condenses at the end of the pipe in heat transfer relationship with said medium (the exhaust gas in the apparatus according to the invention) and evaporates again at the other end of the heat pipe. Flow of liquid from the condensing end of the heat pipe to the evaporating end may be by gravity or by capillary action, or a combination of both. The heat pipe has at least one passage for the flow of vapour in the opposite direction to that of the liquid. Such flow takes place naturally as the result of the condensation of liquid at one end of the pipe.

In the apparatus according to the invention, the working fluid is preferably a fluorocarbon refrigerant, for example FREON R-22.

If desired, the heat pipe may have external fins to facilitate transfer of heat.

Preferably, if the relatively warm fluid is air, the flow of air through the second passage is, in operation, from two to three times that of the exhaust gas. Preferably, the flow of relatively warm air is created by a fan in the second passage upstream of the heat pipe. The speed of the fan in the first passage may be controlled in response to a temperature sensor located at or near the outlet of the cooling chamber. Alternatively, the speed of the fan may be linked to the position of a control valve in a pipeline for supplying liquefied gas (through its cold vapour) to the cooling chamber. The speed of the fan, if provided, in the second passage may be similarly controlled.

BRIEF DESCRIPTION OF THE DRAWING

The apparatus according to the invention will now be described by way of example with reference to the accompanying drawing, which is a schematic diagram of a freezing tunnel fitted with an exhaust system in accordance with the invention.

DESCRIPTION OF THE PREFERRED EMBODIMENTS

Referring to the drawing, there is illustrated a liquid nitrogen freezing tunnel 2. Such freezing tunnels are well known in the art and are readily available commercially, for example, from BOC Limited, Morden under the trademark BOC CRYOMASTER. Accordingly, the internal configuration and mode of operation of the freezing tunnel 2 need not be described in detail herein. The freezing tunnel 2 is provided with a liquid nitrogen supply pipeline 4 having a control valve 6 disposed therein. The pipeline 4 communicates with a source of liquid nitrogen (not shown). The tunnel 2 has an entrance 8 and an exit 10. Food products to be frozen are advanced into the tunnel 2 through the entrance 8 and leave through the exit 10. Within the tunnel 2, the food products come into contact with liquid nitrogen and its cold vapour, the latter flowing countercurrently to the food products. The food products are thereby frozen. Cold vapour is withdrawn from the tunnel 2 through an outlet 12 in its roof at a region near the entrance 8. The outlet 12 forms one end of an exhaust passage 14. The exhaust passage 14 comprises, in sequence, a first length of ducting 16 communicating at one of its ends with the outlet 12; a first channel 20 of a heat exchanger 18, the first channel 20 communicating with the length of ducting 16 at, in use, the cold end 24 of the heat exchanger 18; and a second length of ducting 28 communicating at one of its ends with the first channel 20 of the heat exchanger 18 at its warm end 26. The other end of the length of ducting 28 communicates with a stack (not shown) for safely venting exhaust gas from the freezing tunnel to the atmosphere outside the room (not shown) in which the tunnel 2 is located. A fan 30 is disposed in the second length of ducting 28 and is operable to create a flow of exhaust gas from the tunnel 2 through the first passage 14 to the stack (not shown).

The apparatus is provided with a second passage 32 for the flow of an air stream. The passage 32 extends from an inlet 34 which is open to the atmosphere outside the tunnel 2 with or outside the room (not shown) in which the tunnel 2 is located. The inlet 34 is formed in a third length of ducting 36 which terminates in a second channel 22 through the heat exchanger 18 at its warm end 26. A second fan 38 is located in the ducting 36. The second passage extends from the ducting 36 through the channel 22 into a fourth length of ducting 40 communicating with the channel 22 at the cold end 24 of the heat exchanger 18. The second passage 32 and the fourth length of ducting 40 terminate in an outlet 42 communicating with the atmosphere outside the tunnel 2 in the room in which that tunnel in the room in which that tunnel is located.

Typically, the heat exchanger 18 is located with its channels 20 and 22 generally vertical. With the channels so disposed, a plurality of heat pipes 44 (only one of which is shown) each having external fins 46 extends from the interior of the channel 20 through a column wall 48 separating the channel 20 from the channel 22 into the channel 22. The heat pipes 44 are each inclined at a small angle, but greater than 5° to the horizontal. The end of each heat pipe 44 in the channel 20 is located above that in the channel 22. The arrangement is preferably such that no exhaust gas can pass from the first channel 20 to the second channel 22 and no air in the opposite direction.

In operation of the tunnel 2 to freeze food products, cold nitrogen vapour is generated within the tunnel 2. Both the fans 30 and 38 are operated. The fan 30 draws cold nitrogen vapour from the interior of the tunnel 2 (in admixture with air leaking into the interior of the tunnel 2 from its entrance 8) through the first passage 14. The fan 38 draws a flow of ambient air through the second passage 32 from its inlet 34 to its outlet 42. The heat pipes 44 effect heat exchange between the flow of exhaust gas and the flow of air. The flow of exhaust gas through the channel 20 causes working fluid (typically FREON R 22) within the heat pipes 44 to condense. Condensate flows under gravity through the heat pipe 44 to its end within the second channel 22. The relatively warm ambient air causes such liquid to vaporise and there is a resultant flow of vapour in the opposite direction back to the end of the heat pipe 44 located in the channel 20. There is in consequence rapid transfer of heat from the channel 22 to the channel 20 with the result that the exhaust gas leaving the channel 20 at the warm end of the heat exchanger 18 is warmed to above ambient temperature.

In a typical example of the apparatus according to the invention, the exhaust gas leaving the tunnel 2 through its outlet 12 has a temperature of minus 40° C. and the air entering the second passage 32 through the inlet 34 has a temperature of +19° C. The heat pipes 44 are effective to warm the exhaust gas to +16° C., the cooled air leaving the channel 20 at the cold end 24 of the heat exchanger 18 at a temperature of +4° C. It can therefore be appreciated that no ice will be deposited on any surface of the fan 30. Moreover, we have found that there is surprisingly no or little deposition of ice on the heat transfer surfaces of the heat pipes 44 even during prolonged operation of the apparatus.

If desired, the apparatus according to the invention may be arranged to permit a small proportion of the exhaust gas to by-pass the heat exchanger 18.

I claim:

1. Cooling apparatus comprising, a single cooling chamber; means for injecting a gas or cold vapor thereof into the chamber; an exhaust gas passage for removing exhaust gas from the cooling chamber, said exhaust gas comprising vapor of the liquified gas; flow inducing means in said exhaust gas passage operable to draw said exhaust gas therethrough; and at least one heat pipe having one end in heat transfer relationship with a region of said exhaust passage and an other end in heat transfer relationship with a heat source, whereby, in operation, the heat pipe transfers heat from said heat source to the exhaust gas.

2. Apparatus as claimed in claim 1, in which the flow inducing means comprises a fan.

3. Apparatus as claimed in claim 2, in which the heat source comprises a second passage through which relatively warm fluid is able to passed.

4. Apparatus as claimed in claim 3, additionally including a second fan for passing air, as said relatively warm fluid, through said second passage.

5. Apparatus as claimed in claim 4, in which the inlet of the second passage communicates with a room in which the cooling chamber is located.

6. Apparatus as claimed in claim 5, in which the second passage has an outlet also communicating with the said room.

7. Apparatus as claimed in claim 5, in which the second passage has an outlet communicating with an air conditioning system.

8. Apparatus as claimed in claim 1, in which the chamber is a freezing tunnel adapted to be supplied with liquid nitrogen.

9. Apparatus as claimed in claim 2, in which the chamber is a freezing tunnel adapted to be supplied with liquid nitrogen.

10. Apparatus as claimed in claim 3, in which the chamber is a freezing tunnel adapted to be supplied with liquid nitrogen.

11. Apparatus as claimed in claim 4, in which the chamber is a freezing tunnel adapted to be supplied with liquid nitrogen.

12. Apparatus as claimed in claim 5, in which the chamber is a freezing tunnel adapted to be supplied with liquid nitrogen.

13. Apparatus as claimed in claim 6, in which the chamber is a freezing tunnel adapted to be supplied with liquid nitrogen.

14. The apparatus as claimed in claim 1 wherein said cooling chamber comprises an entrance for receiving an item to be cooled and an exit, said means for introducing liquified gas or its cold vapor into the chamber being located near the exit of the cooling chamber and the outlet for exhaust gas being located near the entrance of the cooling chamber.

15. A cooling apparatus comprising:

a) a single freezing tunnel having an inlet for receiving an uncooled product and an exit for discharging a cooled product;

b) injection means for injecting a liquified gas or cold vapor thereof into the freezing tunnel from a position near the outlet of the freezing tunnel;

c) an exhaust gas passage located near the inlet of the freezing tunnel for removing exhaust gas from the freezing tunnel;

d) flow inducing means within said exhaust gas passage for drawing the exhaust gas into the exhaust gas passage from the freezing tunnel in a countercurrent flow to the direction of the movement of the uncooled product towards the exit of the freezing tunnel; and e) at least one heat pipe having one end in heat transfer relationship with a region of said exhaust gas passage and another end in heat transfer relationship with a heat source whereby the heat pipe transfers heat from said heat source to the exhaust gas.

* * * * *